US008096154B1

(12) United States Patent
Sechtin

(10) Patent No.: US 8,096,154 B1
(45) Date of Patent: Jan. 17, 2012

(54) COMBINATION DOOR LOCK OPERABLE IN POOR VISUAL CONDITIONS, AND RELATED METHOD

(76) Inventor: Alan Gray Sechtin, Florence, SC (US)

( * ) Notice: Subject to any disclaimer, the term of this patent is extended or adjusted under 35 U.S.C. 154(b) by 1078 days.

(21) Appl. No.: 11/308,812

(22) Filed: May 10, 2006

(51) Int. Cl.
*E05B 37/00* (2006.01)

(52) U.S. Cl. ..... 70/284; 70/285; 70/315

(58) Field of Classification Search ..... 70/284, 70/285, 315, 381, DIG. 60, DIG. 71
See application file for complete search history.

(56) References Cited

U.S. PATENT DOCUMENTS

| | | | | | |
|---|---|---|---|---|---|
| 17,804 | A | * | 7/1857 | Munger | 70/306 |
| 844,138 | A | * | 2/1907 | Katzenberger | 70/285 |
| 949,889 | A | * | 2/1910 | Feistner | 70/150 |
| 1,092,474 | A | * | 4/1914 | Carroll | 70/284 |
| 1,217,392 | A | * | 2/1917 | Berchtold | 70/29 |
| 1,410,033 | A | | 3/1922 | Pass | |
| 1,688,207 | A | * | 10/1928 | Del Rosso | 70/284 |
| 1,937,165 | A | * | 11/1933 | Umberto Piagneri | 70/284 |
| 1,981,163 | A | * | 11/1934 | Carlson | 70/150 |
| 2,110,094 | A | * | 3/1938 | Pauloski et al. | 70/284 |
| 2,580,830 | A | * | 1/1952 | Pelle | 70/156 |
| 3,455,125 | A | * | 7/1969 | Silva Augusto Tavares Da | 70/186 |
| 3,821,885 | A | | 7/1974 | Gerry | |
| 3,903,718 | A | * | 9/1975 | Fish | 70/156 |
| 5,010,754 | A | | 4/1991 | De Angelo | |
| 5,063,764 | A | | 11/1991 | Amis et al. | |
| 5,291,767 | A | * | 3/1994 | Weindorf et al. | 70/370 |
| 5,351,513 | A | * | 10/1994 | Ellis | 70/370 |
| 6,708,538 | B1 | * | 3/2004 | Walby | 70/285 |
| 6,729,169 | B2 | * | 5/2004 | Moore | 70/472 |
| 7,207,199 | B2 | * | 4/2007 | Smith et al. | 70/134 |
| 7,913,525 | B2 | * | 3/2011 | Ma | 70/25 |
| 2005/0166649 | A1 | * | 8/2005 | Meekma | 70/134 |
| 2008/0196460 | A1 | * | 8/2008 | Houlihan et al. | 70/285 |

* cited by examiner

*Primary Examiner* — Suzanne D Barrett
(74) *Attorney, Agent, or Firm* — Jonathan Rigdon Smith, PC; Jonathan R. Smith

(57) ABSTRACT

A door lock is openable by a key from outside and by a combination mechanism from the inside. The interior combination mechanism may alternatively be supplemented by a key mechanism. The combination is entered by positioning the hands of a simulated clock, an array of push buttons, an array of sliding rods, or a rotating dial. A method is also provided for changing the combination.

1 Claim, 8 Drawing Sheets

COMBINATION DOOR LOCK OPERABLE IN POOR VISUAL CONDITIONS, AND RELATED METHOD

FIELD OF INVENTION

This invention is in the field of locks for security, more specifically door locks, specifically door locks openable by both key and combination. The invention is also in the field of mechanisms operable under impaired vision conditions.

BACKGROUND OF THE INVENTION

A common type of door lock used in exterior doors on dwellings is a deadbolt operable by a crank or knob on the inside of the door and by a key only on the outside. An exterior door of high quality is built strong enough to resist being kicked in, but many such doors nevertheless have frangible, e.g., glass, panels built into them (or adjacent to them in the door frame). Would-be intruders can break such panels, allowing them to reach in and open the lock from the inside. One prior art solution is to provide key operation from both sides of the door. The obvious problem with this solution is that if the door is locked, it cannot be opened without a key. This poses a safety concern in an emergency. Oftentimes, residents simply leave a key in the inside keyhole, effectively converting this type of lock into the inside crank type mentioned first above.

Thus, a need exists to provide a lock that may be opened from the outside by key and from the inside by a mechanism operable in poor lighting conditions principally by a tactile process known by the residents but difficult to guess by an intruder (with, or optionally without, a key).

The typical prior art combination dial must be manipulated carefully in good light. (In this application, the word "combination" means the series of numbers and letters used to open a lock.) Most people have experienced, at some time in their lives, having to re-enter a combination multiple times because of imprecision in dialing. Such combinations ordinarily require the memorization of three double-digit numbers. These conditions can pose a difficulty for young children and for anyone trying to open the lock in low-light conditions. Therefore, a need also exists for a new type of combination mechanism for the inside that would be easy to open quickly in dim light, yet be difficult for a would-be intruder to operate through a hole in the door.

BRIEF DESCRIPTION OF THE INVENTION

The preferred embodiment of this invention is a door lock openable by key from either the exterior or the interior, and by a tactile permutation mechanism from the interior. (In this application, the word "permutation" means number of elements that can be arranged in a particular order.) The lock mechanisms and housing would be sized to replace conventional door locks. Other embodiments employ other permutation mechanisms, either with or without the keyed exterior option. A method of changing the permutation of the principal and second embodiments is also provided.

OBJECTS OF THE INVENTION

The principal objects of this invention are to provide a door lock that can be opened from the inside via a permutation, and further that the permutation can be entered quickly and entirely by touch. Another object is to provide such a lock with simple, all-mechanical construction. Yet another object is to provide a permutation that may be remembered and entered quickly by a child in low-light conditions. Another object is to foil operation of the bolt by an unauthorized person breaking through a frangible portion of the door and simply turning the crank. A further object is to provide such a lock with means for changing the permutation. Another object is to provide such a lock that would fit existing lock apertures in a door.

DETAILED DESCRIPTION OF THE INVENTION

The preferred embodiment of this invention is a substitute for the typical through-the-door, key-on-the-outside deadbolt lock, wherein, instead of using solely a crank or knob on the inside of the door to withdraw the bolt from the door jamb, a permutation lock mechanism is used. The permutation utilizes "hands" on a simulated clock face for tactile input of a simple permutation. An "hour" and a "minute" hand are each used to enter any one of a limited number (e.g., twelve) numeric inputs, meaning that, e.g., 144 different permutations are available. Detents are provided within the mechanism to permit easy and precise positioning of the minute and hour hands on any one of the pre-selected numbers. Each possible permutation is an easy-to-recall "time of day" on a twelve-hour clock, and each time of day may be selected by feel. Other embodiments of the present invention involve the use of other mechanisms for entry of a permutation.

Figure 1:
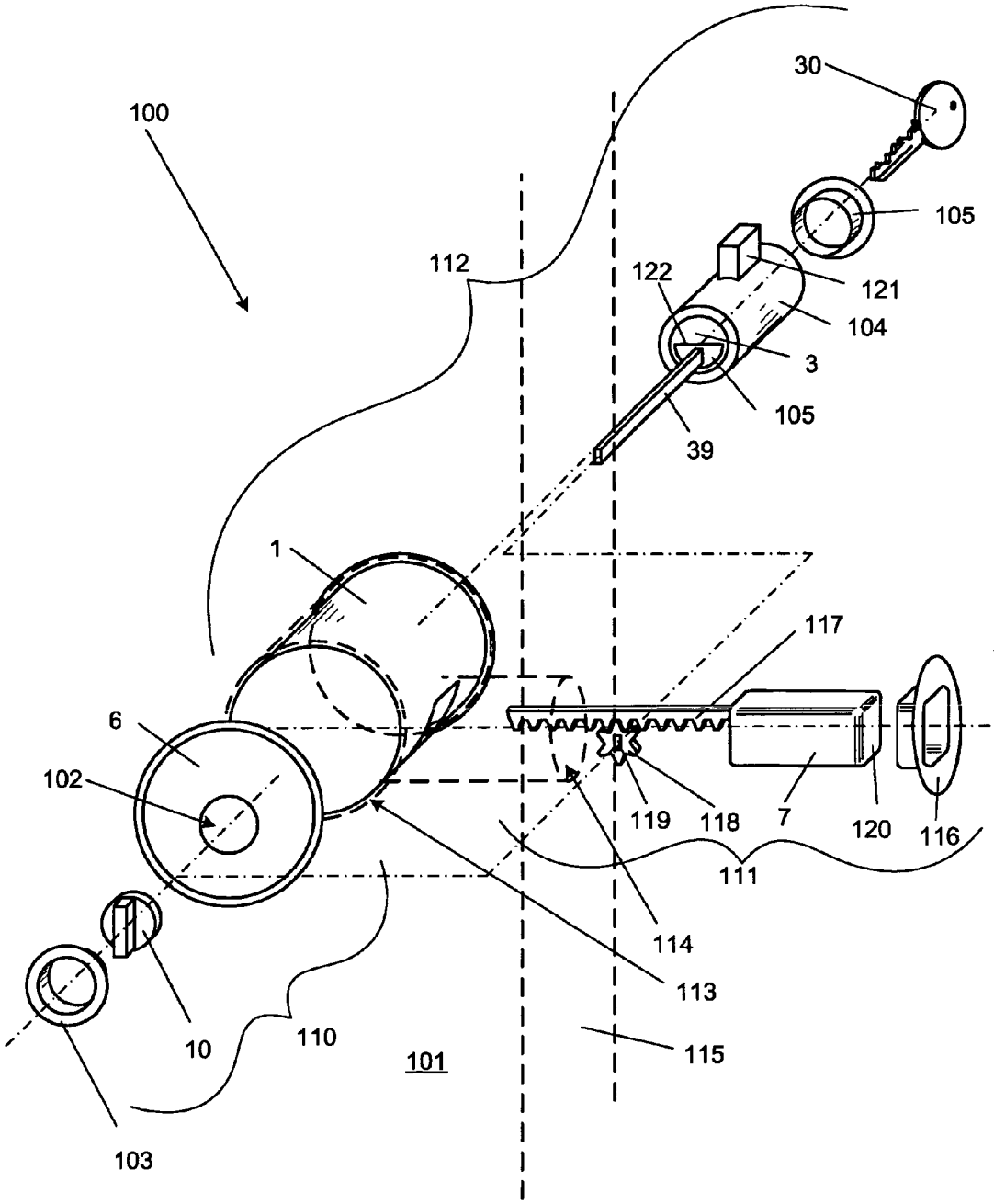
FIG. 1 PRIOR ART
FIG. 1 is a front (i.e., from the interior) exploded view of a prior art crank deadbolt lock.

Referring now to the drawings, in which like reference numerals refer to like elements in each of the drawings, FIG. 1 is an exploded view of a prior art crank deadbolt lock 100, as seen from the interior side of the door 101 in which the lock is mounted. The entire assembly typically consists of an interior portion 110, a bolt portion 111, and an exterior portion 112. A large hole 113 is drilled through door 101 from interior to exterior to accommodate interior portion 110 and exterior portion 112. A smaller hole 114 is drilled perpendicularly to the axis of hole 113 from door edge 115 to accommodate bolt portion 111.

Interior portion 110 comprises a crank 10 which rotates within a hole 102 in an interior panel 6. Interior panel 6 is affixed to the interior side of door 101. Crank 10 may be held in place slidably against interior panel 6 by an inner bezel 103. Bolt portion 111 is installed within hole 114, and typically comprises a bolt 7 which can slide coaxially within hole 114 and through bolt bezel 116. Bolt 7 is moved horizontally by rack 117 and pinion 118.

A lock cylinder 104 is fixed to the exterior side of the door 101 in housing 1 by an outer bezel 105. An outer plug 3, within cylinder 104, accepts a key 30 in its outer end (not visible). The key can turn plug 3 within cylinder 104. The inner end of plug 3 holds a tailpiece 39 within a semicircular opening 105. Tailpiece 39 can rotate slidably +/−90 degrees about its longitudinal axis within semicircular opening 105, even when plug 3 remains stationary (is not turned by a key) within cylinder 104. When the exterior portion 112 of lock assembly 100 is installed in hole 113, tailpiece 39 is passed through pinion slot 119 and inserted into a slot (not visible) in the back of crank 10. A means is provided (not shown) within hole 113 for maintaining the teeth of rack 117 in engagement with the teeth of pinion 118. Interior panel 6 and housing 1 are typically fastened to the door frictionally, by bolts (not shown) fastening interior panel 6 to housing 1 though hole 113. Bolt bezel 116 is typically fastened to door edge 115 with screws (not shown).

When the lock is open, the right end 120 of bolt 7 is flush with the right face of bolt bezel 116. To close the lock from inside a dwelling, crank 10 is turned clockwise, which turns tailpiece 39 clockwise within pinion 118. Pinion 118 then rotates clockwise, extending rack 117 rightwardly. Rack 117 then pushes bolt 7 to the right to engage a door jamb (not shown) thereby locking the door. The opposite turning of the crank unlocks the door.

The door is unlocked from the outside by the key 30 after it is inserted into outer plug 3. The key 30 typically aligns lift pins (not shown) within a bible 121, permitting outer plug 3 to be rotated counterclockwise (in this view) within cylinder 104. To turn tailpiece 39 counterclockwise within pinion 118 sufficiently to pull bolt 7 free of the door jamb, key 30 and plug 3 must be rotated more than 90 degrees to bring upper edge 122 of semicircular opening 105 into contact with tailpiece 39. The opposite rotation of the key 30 more than 180 degrees in the opposite direction locks the door.

Figure 2:
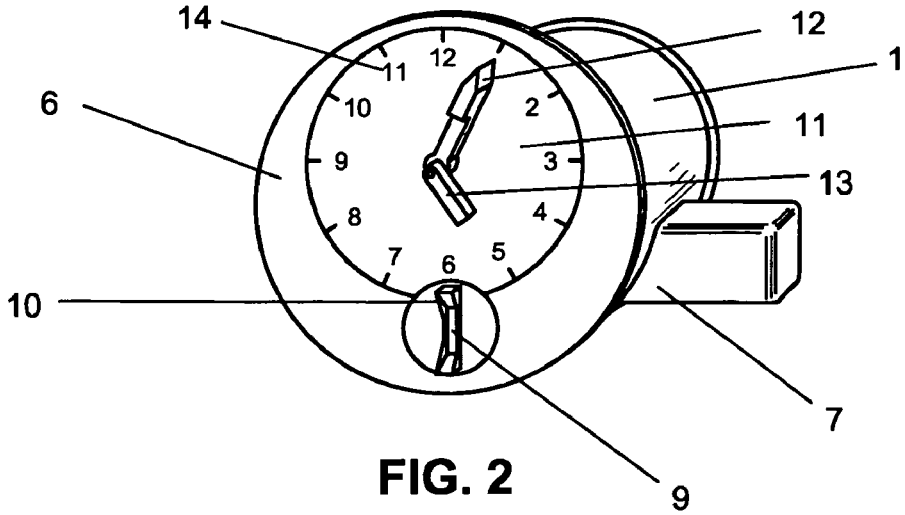
FIG. 2 is a front perspective view of the first, preferred, embodiment of the invention.
Figure 3:
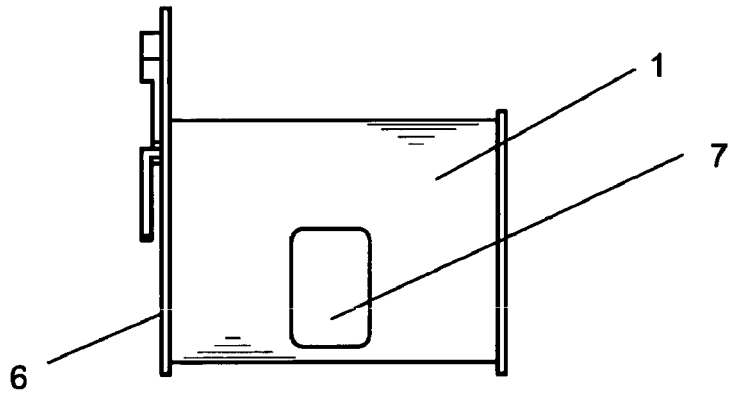
FIG. 3 is a right side view of the preferred embodiment.
Figure 4:
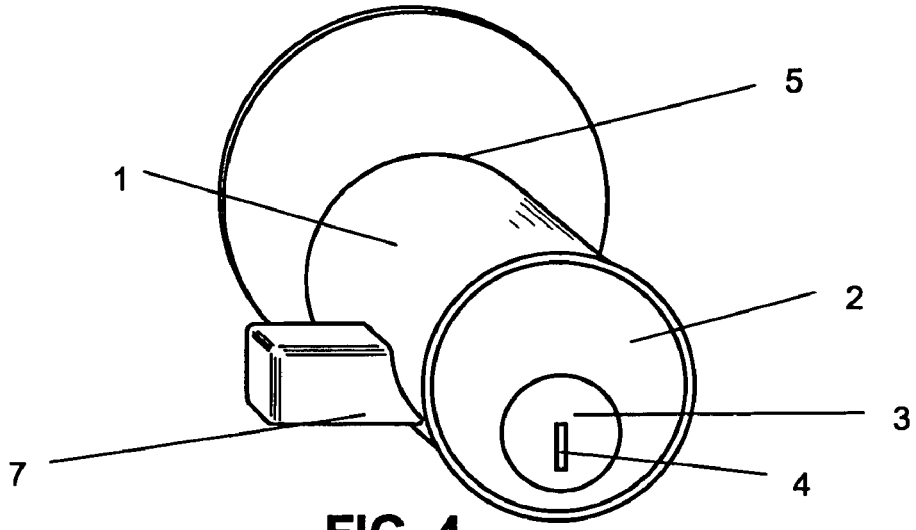
FIG. 4 is a rear perspective view of the preferred embodiment.

FIGS. 2, 3, and 4 are front perspective, right side, and rear perspective views, respectively, of the exterior surfaces of the first, preferred, embodiment of the invention. The preferred embodiment, as shown in FIG. 2, comprises some elements of the prior art: a housing 1, preferably sized to fit preexisting holes in a door; an interior panel 6; a crank 10; and a bolt 7 extending rightwardly from housing 1. FIG. 2 further shows inventive elements including: clock face 11, "minute" hand 12, "hour" hand 13; and clock indicia 14. FIG. 3 shows some of these elements from the right side. FIG. 4, the rear perspective view, shows elements outer plug 3 and exterior keyhole 4, which permit keyed access to the dwelling from the exterior.

In FIG. 2, the settings of minute hand 12 and hour hand 13 on one or two of the twelve clock indicia 14 constitute the permutation of the lock (here shown as 5:05). It may be entered in the dark, even by children, to open the lock from the inside of a dwelling without the use of a key, particularly if detents (not shown; see the following figures) are provided within the mechanism to permit easy and precise positioning of the hands on the clock indicia.

Two hands, positionable separately at twelve distinct indicia, provide 144 permutations of settings. It may seem at first glance that 144 permutations is an insufficient number to deter unauthorized entry. That might be true were the clock hands to be used for exterior access to the dwelling. It would be possible for a patient and lucky would-be trespasser to run through the 144 permutations and find the one that opens the lock. However, the principal object of this invention is to allow quick opening from the inside, while frustrating an unauthorized person. Many would-be intruders will go so far as to break glass or a panel in a door, without actually destroying the door. Such a person would be frustrated by finding clock hands and the necessity of working through all of the permutations by feel, backwards, through a hole in the door.

Another option within the scope of this invention is to provide another clock hand (corresponding to a clock "second" hand—not shown) distinguishable from the other two by feel. This would require the memorization of a third number (e.g., 5:05:40) but would expand the number of possible permutations to 1,728.

Figure 5:
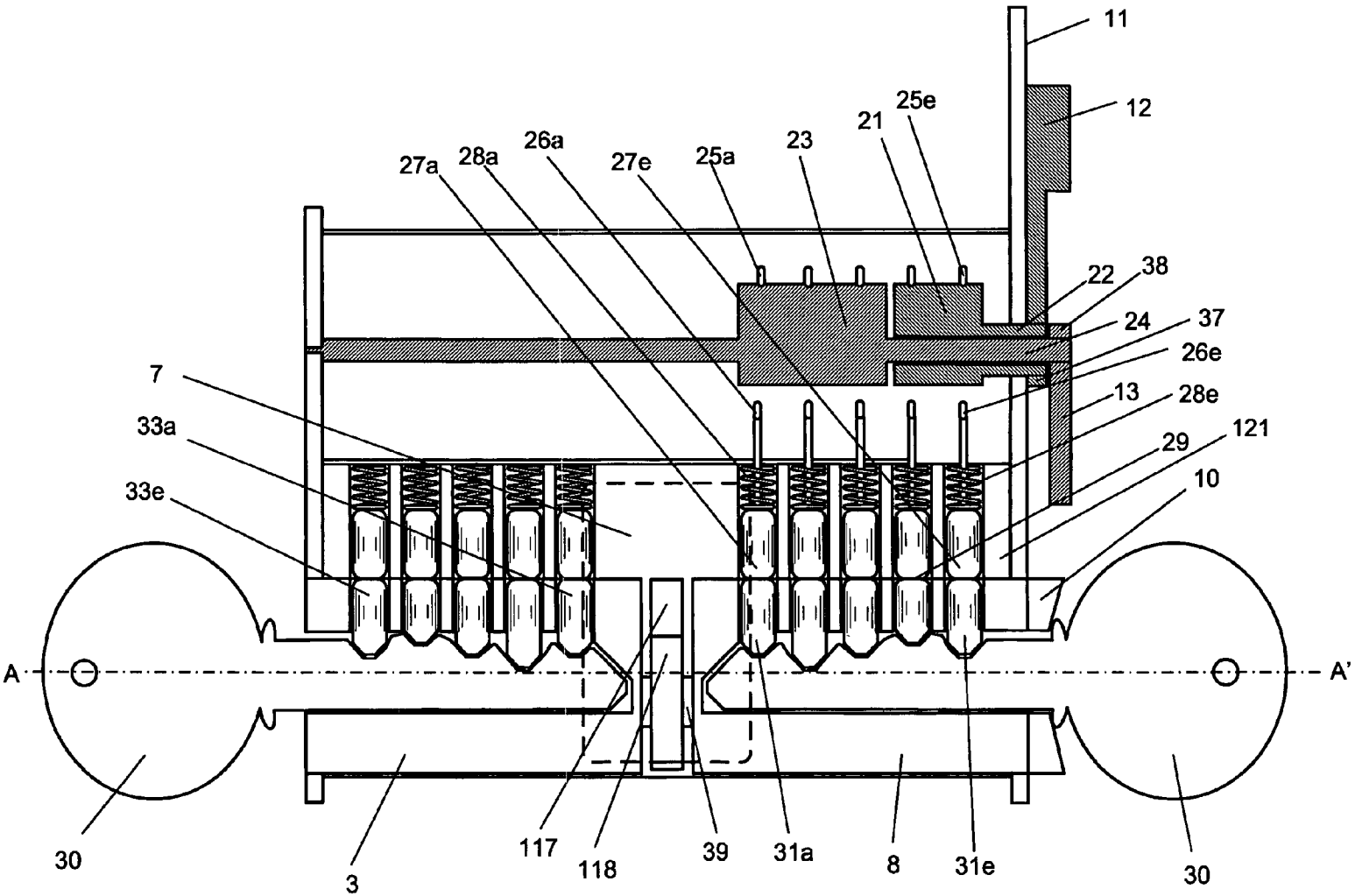
FIG. 5 is a cross-sectional left side view of the preferred embodiment.
Figure 6:
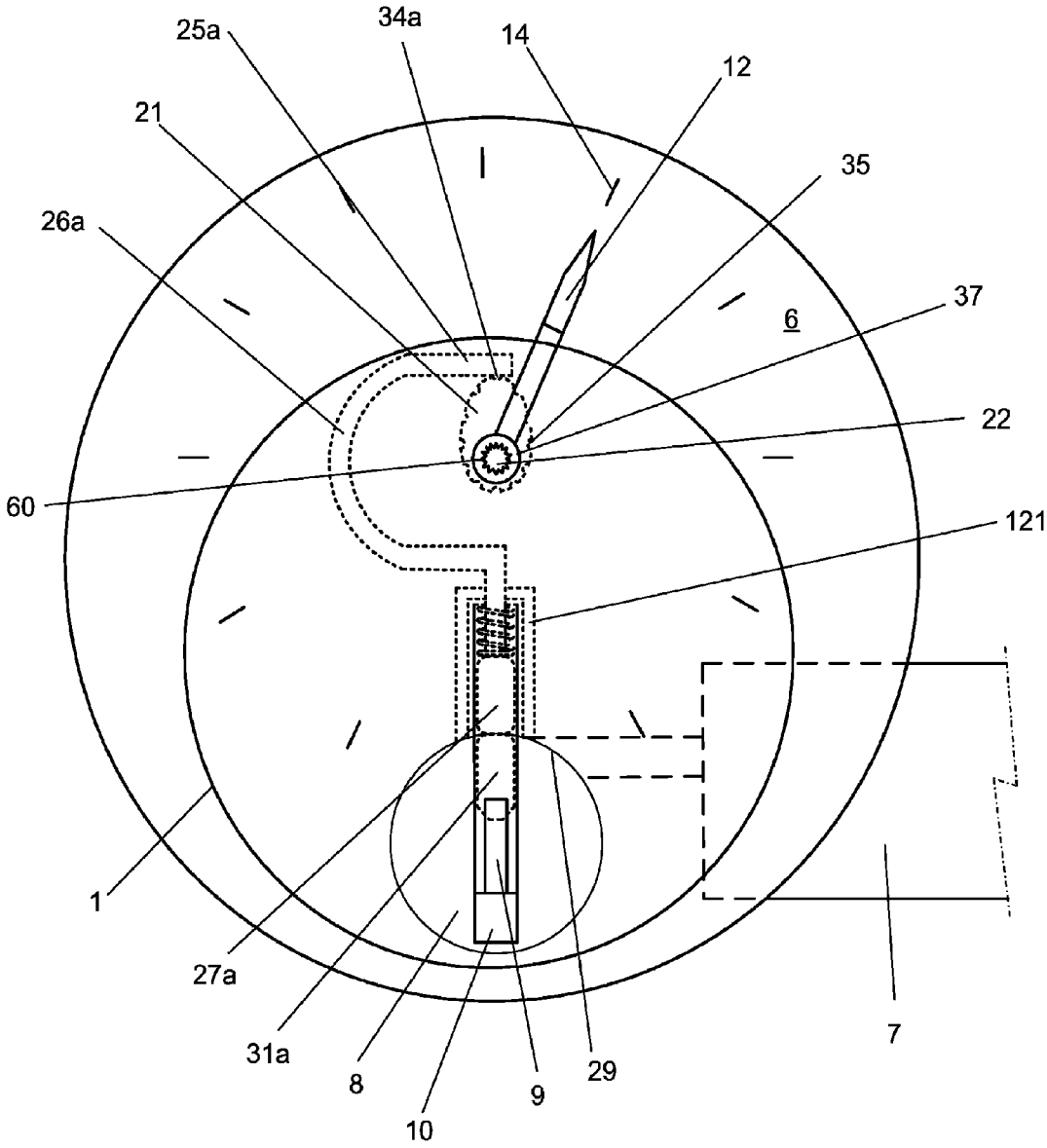
FIG. 6 is a front view of the preferred embodiment of the invention.

FIG. 5 is a cross-sectional left side view of the preferred embodiment, depicting the inner workings of one possible tactile plug release mechanism that accomplishes the above objects. Minute hand 12, sliding on clock face 11, is rigidly attached to a first cam 21 by means of a hollow shaft 22. Hour hand 13, shaped to avoid interfering with minute hand 12, is rigidly attached to a second cam 23 via a solid shaft 24. Hollow shaft 22 is axially mounted on solid shaft 24 so that minute hand 12 and first cam 21 revolve independently of hour hand 13 and second cam 23. The cams 21 and 23 are of rectangular cross-section in this view (parallel to their axes of rotation) but are of ovoid or elliptical cross-section in a plane normal to their axes of rotation (see FIG. 6). In FIGS. 5 and 6, the cams are shown at their maximum upward extent, at which position they hold five retractor heads 25*a*-25*e* (only 25*a* and 25*e* are marked) at their maximum height. The retractor heads are connected to retractors 26*a*-26*e*, which pull inner release pins 27*a*-27*e* upward against inner pin springs 28*a*-28*e* until their lower edges line up with the cylindrical surface 29 of inner plug 8. With the inner release pins arrayed thus, inner plug 8 may be rotated about axis A-A', turning tailpiece 39 within pinion 118, pulling rack 117 and retracting bolt 7 (dashed lines). A key 30 may be alternatively used to lift inner release pins 27*a*-27*e* to the same surface 29 by pushing inner lift pins 31*a*-31*e* upwardly against the inner release pins in a manner known in the prior art. The inner release pins 27*a*-27*e*, inner pin springs 28*a*-28*e*, and inner lift pins 31*a*-31*e* are constrained to move vertically within bible 121.

If the clock hands are used to unlock the door from the inside without a key, plug 8 is turned by means of crank 10. When the key 30 is used on the inside or outside to unlock the door, the key itself may used to turn outer plug 3 or inner plug 8, respectively.

When key 30 is used by itself in outer plug 3, it aligns an array of outer lift pins 33*a*-33*e* that is the mirror image of inner lift pins 31*a*-31*e*, thereby allowing plug 3 to be rotated. Tailpiece 39 extends between plugs 3 and 8, passing through pinion 118. Semicircular holes (not shown, but similar to reference 105 in FIG. 1) permit the plugs 3 and 8 to be turned independently of each other to rotate pinion 118, withdrawing the rack 117 and the bolt 7.

The permutation setting for minute hand 12 may be changed when it is pointing to its lock-opening "minute" setting by removing minute hand collar 37, which is splined (see reference character 60 in FIG. 6) or otherwise shaped on the inside surface, from the mating splined or otherwise shaped hollow shaft 22, and reattaching it at a different minute setting. Similarly, hour hand 13 may be reset by removing hour hand collar 38 from, and reattaching it to, solid shaft 24. Thus is described a method for resetting the permutation of the preferred embodiment.

FIG. 6 is a front view of housing 1 showing some of the same mechanisms depicted in FIG. 5. Parts located behind interior panel 6 are in dashed lines to indicate that they are behind interior panel 6. This provides a better view of splines 60, retractor 26*a*, retractor head 25*a*, and first cam 21. Inner release pin 27*e* and inner pin spring 28*e* are shown within bible 121. Note that a bump 34*a* is provided under retractor head 25*a* to mate with detents 35 in the surface of first cam 21. This causes minute hand 12 to align preferentially with clock indicia 14 on interior panel 6 as it is rotated to find a particular number. The same features are provided on the hour hand parts (not shown in this view).

After a conventional combination lock is used, it is commonplace to scramble the dial (in this case, clock "hands") afterwards to prevent revealing it. This should be done on a door lock comprising the present invention, after it is used for egress, as soon as it is desired to re-secure the interior of the dwelling. It is especially desirable to do so before the door is expected to be opened from the interior repeatedly, as in the case of a social gathering where guests need to be able to enter and leave without having to enter the permutation. In such an event, the key can be inserted into, and left in, the interior keyhole 9 for as long as desired, but the clock hands should be scrambled in advance so that the permutation is not revealed to everyone in attendance by their position. The clock hands can be scrambled freely while the key is in the lock because having the key in plug 8 lifts retractor heads 25*a* etc. to their maximum height, leaving first cam 21 (and second cam 23, not visible) free to rotate to any position underneath the retractor heads.

Figure 7:
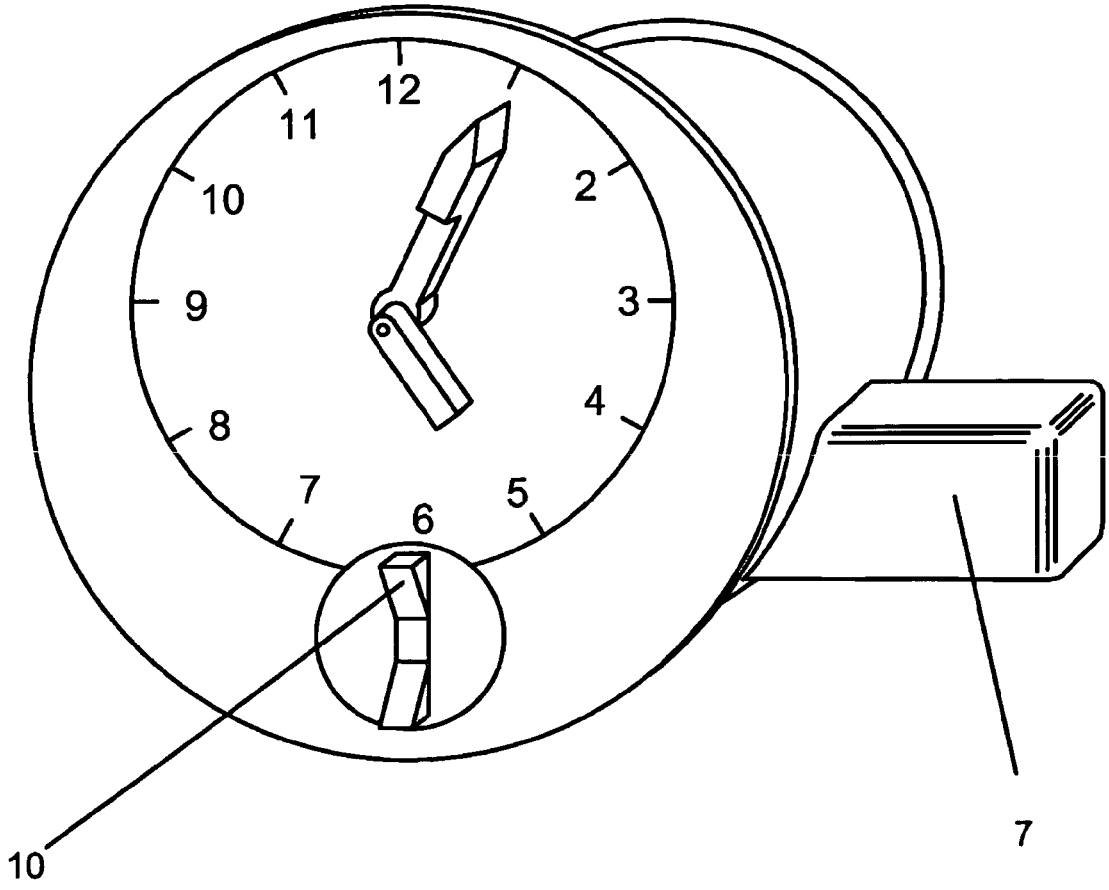
FIG. 7 is a front perspective view of the second embodiment of the invention.

FIG. 7 is a front perspective view of a second embodiment of the invention, nearly identical to the preferred embodiment, having no provision for an interior key. There is no keyhole in crank 10. Only the outer plug (not visible—see FIG. 5) provides a key mechanism to retract bolt 7.

Also within the scope of the present invention manifested in additional embodiments is the use of an array of push buttons, sliding rods, or a permutation dial on the inside of the door to move cams within the mechanism and effect release of a lock plug. A given pattern or sequence of button-pushings, rod-positionings, or dial rotations would effect release of the lock. These embodiments are illustrated in FIGS. 8 through 14. To meet the needs and objects of this invention, these mechanisms on the inside of the door should, unlike conventional combination locks, not depend on visual entry of input.

Figure 8:
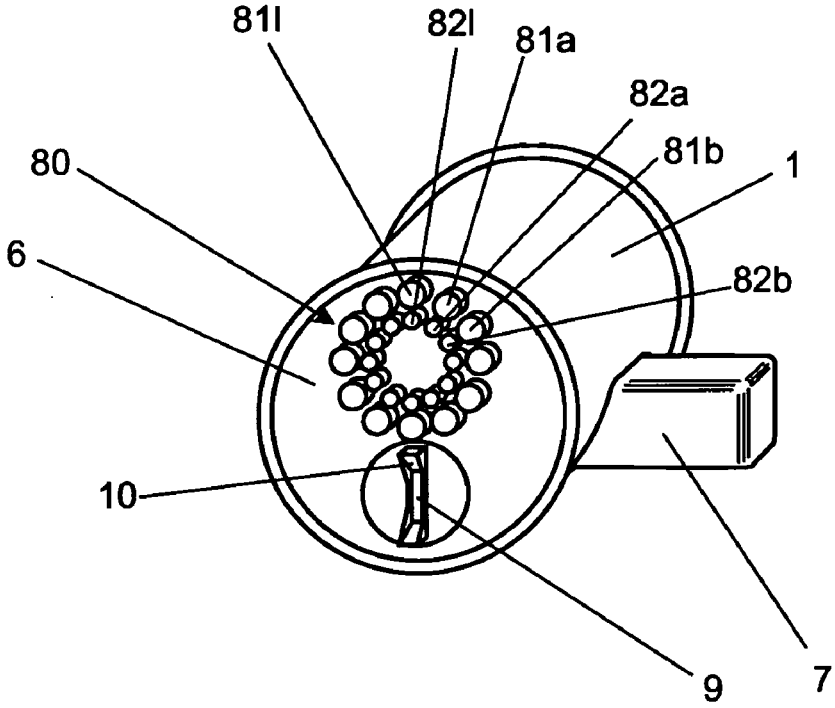
FIG. 8 is a front perspective view of the third embodiment.

FIG. 8 is a front perspective view of the third embodiment of the invention, being similar to the first, preferred embodiment, but employing a push button mechanism 80 on interior panel 6 in place of the clock hands of the first, preferred, embodiment. An outer circular array of push buttons 81*a*, 81*b*, . . . 81*l* are numbered 5, 10, . . . 0 to simulate minute indicia, and an inner circular array of push buttons 82*a*, 82*b*, . . . 82*l* are numbered 1, 2, . . . 12 to simulate hour indicia, to aid in memorization of a "time" permutation for the lock. When a user pushes two buttons corresponding to a memorized "time," corresponding wafers (not visible) are pushed out of corresponding detents (not visible) on a permutation disk (not visible) within the housing 1, allowing crank 10 to turn tailpiece 39 (not visible), releasing bolt 7. An interior keyhole 9 is provided as well, as an alternative to the push buttons, to turn inner plug 8 (not visible).

Figure 9:
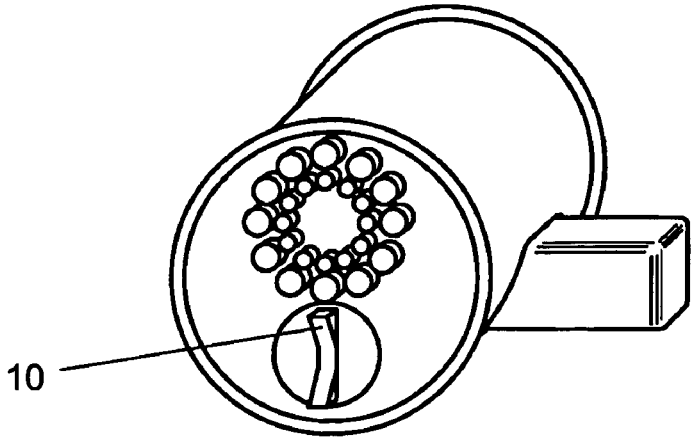
FIG. 9 is a front perspective view of the fourth embodiment.

FIG. 9 is a front perspective view of the fourth embodiment of the invention, being similar to the third embodiment, but not having an interior key option (indicated by the absence of a keyhole in crank 10).

Figure 10:
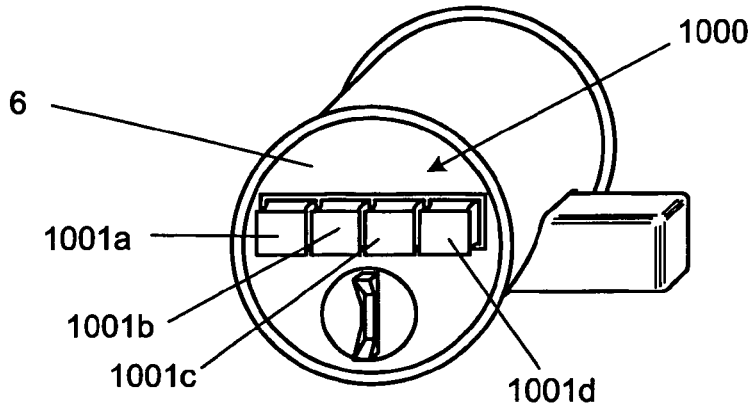
FIG. 10 is a front perspective view of the fifth embodiment.

FIG. 10 is a front perspective view of the fifth embodiment of the invention, similar to the first embodiment, but employing a sliding rod mechanism 1000 on interior panel 6 in place of a simulated clock. A plurality of rods, in this case four, 1001*a*, 1001*b*, . . . , 1001*d* may be pulled in and out of interior panel 6. Each rod may be positioned in a plurality of extents outwardly of interior panel 6, in this case three. Thus, in this case, 64 different permutations are possible using a simple sequence of four positionings.

Figure 11:
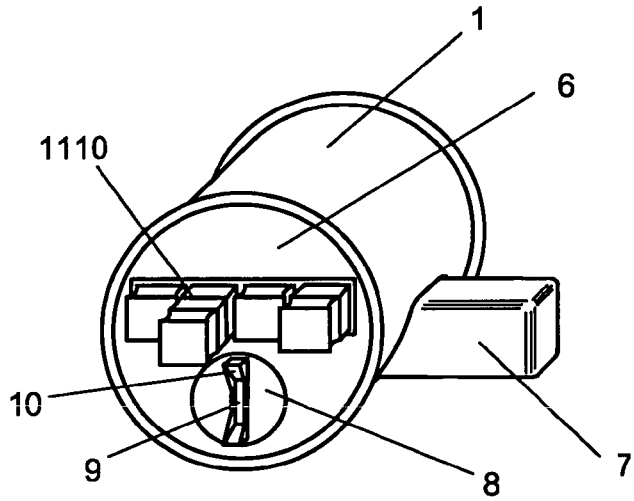
FIG. 11 another front perspective view of the fifth embodiment.

FIG. 11 is another front perspective view of the fifth embodiment, showing how the sliding rods are selectively positioned to register a particular permutation opening the lock. In this case the permutation, i.e., the sequence of four rod positionings, is: 1-3-1-2 (1=rod 1001*a* is fully in; 3=rod 1001*b* is fully out; 1=rod 1001*c* is fully in; 2=rod 1001*d* is in the middle position.) A detent groove 1110 can be seen on rod 1001*b*. All four rods have such detents, which enable the user to position the rod by feel in the precise lock release orientation. Rod 1001*d* is positioned on its middle detent groove; therefore the detent groove is obscured by interior panel 6. When a user sets the four rods corresponding to a memorized set of four positions, corresponding grooves (not visible) in the rods line up so that a disk (not visible) within the housing 1, attached to crank 10, moves through the grooves, allowing crank 10 to turn inner plug 8 and its tailpiece (not visible—see FIG. 5), releasing bolt 7. An interior keyhole 9 is provided as well, as an alternative to using the rods to release inner plug 8.

Figure 12:
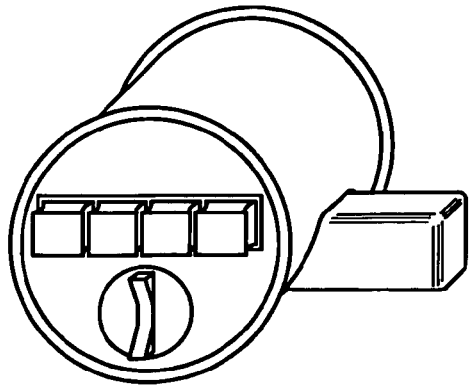
FIG. 12 is a front perspective view of the sixth embodiment.

FIG. 12 is a front perspective view of the sixth embodiment of the invention, similar to the fifth embodiment, but not having an interior key option.

Figure 13:
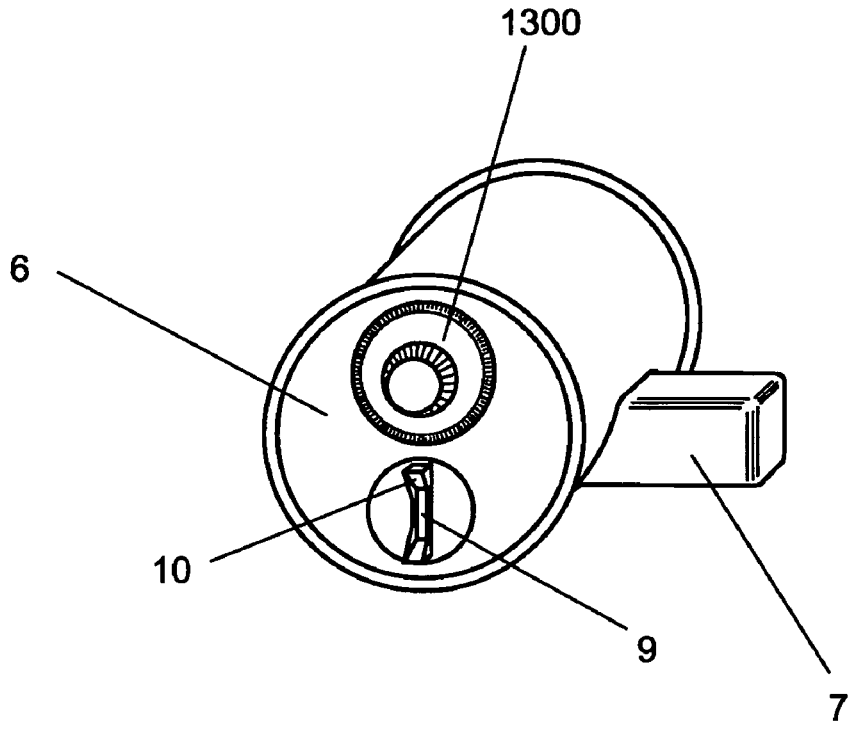
FIG. 13 is a front perspective view of the seventh embodiment.

FIG. 13 is a front perspective view of the seventh embodiment of the invention, similar to the first embodiment, but employing a permutation dial mechanism on interior panel 6 in place of clock hands. Permutation dial 1300 turns tumblers within the mechanism (not shown) positioning release pins (not shown—see FIG. 5) to permit crank 10 to be turned, withdrawing bolt 7. A key may also be used at interior keyhole 9 or an exterior keyhole (not visible—see FIG. 5). The correct positioning of each tumbler is made detectable by feel, sound, or light as an alternative to reading numbers on a dial, so long as these indications are difficult to sense by a would-be intruder on the outside of the door.

Figure 14:
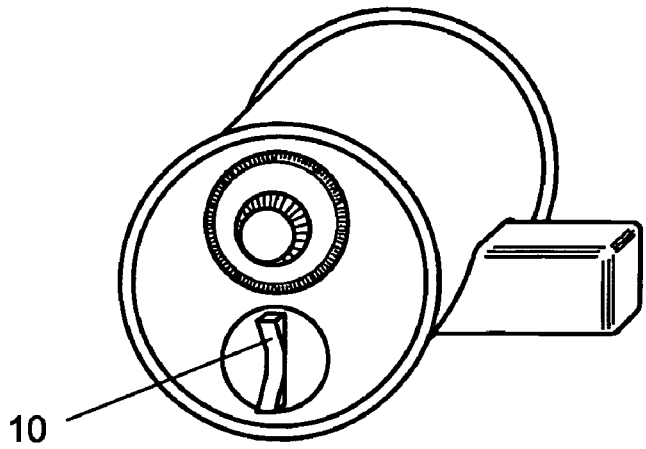
FIG. 14 is a front perspective view of the eighth embodiment.

FIG. 14 is a front perspective view of the eighth embodiment of the invention, similar to the seventh embodiment, but not having an interior key option. Crank 10 is turned to open the lock after the permutation is entered.

What is claimed is:

1. A door lock operable in poor lighting conditions mounted in a cavity through a door, comprising:

a bolt, extensible from the edge of a door to lock the door;

means for enabling a first key, from a first side of the door, to withdraw the bolt; and means for enabling a permutation device selectable according to a memorized spatial orientation, from the second side of the door, to withdraw the bolt;

the permutation device selectable according to a memorized spatial orientation being either a) an array of push buttons;

b) an array of sliding rods;

c) at least one dial, or d) a simulated clock face having at least one clock hand;

the means for enabling the permutation device selectable according to a memorized spatial orientation, from the second side of the door, to withdraw the bolt, comprising a plug that can be turned from the second side of the door that withdraws the bolt when turned;

a crank at one end of the plug for manually turning the plug;

the plug disposed through a second hole in the second side of the door;

a hollow cylinder disposed coaxially to the second hole and extending from the second side of the door perpendicularly into the cavity, and the plug disposed within the hollow cylinder so that the plug can rotate slidably and coaxially within the hollow cylinder;

the inner wall of the hollow cylinder and the outer wall of the plug forming a common cylindrical surface;

at least one pin having a first end and a second end;

the first end of the at least one pin being linearly translatable in response to orientation of the permutation device, the second end of the at least one pin being linearly translatable perpendicularly through the inner wall of the hollow cylinder, so that the second end of the at least one pin can move into and out of a mating socket in the plug;

the at least one pin preventing rotation of the plug when the second end of the at least one pin is in a mating socket, and allowing rotation of the plug only when the at least one pin is moved out of the mating socket in response to orientation of the permutation device.

* * * * *